US011186932B2

(12) United States Patent
Snow et al.

(10) Patent No.: US 11,186,932 B2
(45) Date of Patent: Nov. 30, 2021

(54) MAGNETIC PIN HOLDER

(71) Applicants: Heather M. Snow, Sunnyvale, CA (US); Zachary S. Snow, Sunnyvale, CA (US); Andrew T. Snow, Sunnyvale, CA (US)

(72) Inventors: Heather M. Snow, Sunnyvale, CA (US); Zachary S. Snow, Sunnyvale, CA (US); Andrew T. Snow, Sunnyvale, CA (US)

( * ) Notice: Subject to any disclaimer, the term of this patent is extended or adjusted under 35 U.S.C. 154(b) by 310 days.

(21) Appl. No.: 16/601,142

(22) Filed: Oct. 14, 2019

(65) Prior Publication Data

US 2020/0340161 A1 Oct. 29, 2020

Related U.S. Application Data

(60) Provisional application No. 62/837,547, filed on Apr. 23, 2019.

(51) Int. Cl.
*D05B 91/12* (2006.01)
*B65D 85/24* (2006.01)

(52) U.S. Cl.
CPC ..... *D05B 91/12* (2013.01); *B65D 85/24* (2013.01); *D05D 2207/06* (2013.01)

(58) Field of Classification Search
CPC . D05B 91/06; D05B 91/12; A45F 3/20; A45F 2003/205; B65D 85/24; D05D 2207/06
USPC ..... 223/109 A, 109 R, 106–108; 206/218
See application file for complete search history.

(56) References Cited

U.S. PATENT DOCUMENTS 1,046,065 A * 12/1912 Grobman ..... D05B 91/12 223/109 R
2,037,628 A * 4/1936 Hogarth ..... D05B 91/12 223/109 R
2,217,514 A * 10/1940 Henry ..... B43L 25/00 220/628
2,452,400 A * 10/1948 Stevens ..... A45F 5/00 224/183
2,600,589 A * 6/1952 Swanson ..... D05B 91/12 223/109 R
2,888,136 A * 5/1959 La Borde ..... D05B 91/12 206/350
2,928,534 A * 3/1960 Cheun ..... B65D 83/02 312/73

(Continued)

FOREIGN PATENT DOCUMENTS

EP 2177121 A1 * 4/2010 ..... A41H 19/00

*Primary Examiner* — Nathan E Durham
(74) *Attorney, Agent, or Firm* — Steven A. Nielsen; www.NielsenPatents.com

(57) ABSTRACT

A pin cup that may be disposed within a shell, with the shell moving along a vertical axis to accommodate an open or closed position. In an open position the shell may lower, exposing the pins in the pin cup. In a closed position the shell may raise, so as not to disturb the pins in the pin cup, but to allow the lid to cover the pins in a position above the pins. A disclosed embedment (100) may comprise a lid (110) a shell (120) a pin cup (130) and other components. Outer surfaces of a pin cup may interact with inner surfaces of a shell so as to allow the pin cup to lock in a lower position, travel to an upper position, lock in the upper position and be toolessly removed from the shell.

4 Claims, 9 Drawing Sheets

(56) References Cited

U.S. PATENT DOCUMENTS

| | | | | |
|---|---|---|---|---|
| 3,982,631 | A * | 9/1976 | Kunik | B65D 83/02<br>206/380 |
| 2015/0252505 | A1* | 9/2015 | Schmidt | D05B 83/00<br>112/475.01 |
| 2019/0106823 | A1* | 4/2019 | Kawasaki | D05B 91/12 |

* cited by examiner

MAGNETIC PIN HOLDER

CROSS-REFERENCE TO RELATED APPLICATIONS

This utility application claims the benefit and priority date of provisional patent application 62/837,547 filed on Apr. 23, 2019, the contents of which are incorporated herein be referenced as if restated herein.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to pin holding systems. More particularly, the invention relates to means and methods of creating a new device for safely and efficiently containing sharp objects such as pins.

(2) Description of the Related Art

The known related art fails to anticipate or disclose the principles of the present invention.

In the related art pin cushions are known as well as FRED'S HEADS-UP MAGNETIC PIN WELLS. Pin cushions are not well suited for travel. While Fred's Heads-Up Magnetic pin wells provide a well or magnetic cup for holding pins, there are no provisions for providing a secure top system nor means of retraction of the pins for storage. Thus, there is a need in the art for the presently disclosed embodiments.

BRIEF SUMMARY OF THE INVENTION

The present invention overcomes shortfalls in the related art by presenting an unobvious and unique combination and configuration of methods and components to create a new container system for presenting pins for quick extraction and for safely transporting pins without the pins being jostled out of position. Unlike the prior art of Fred's Heads-Up product, the presently disclosed embodiments provide a simple one piece and nearly planar cover that spans over the stored pin heads while spanning the vertical sidewalls.

Unlike the prior art where such sidewalls are static, the presently disclosed embodiments present telescopic sidewalls that raise and lower for use or storage. The sidewalls may be comprised of concentric cylinder sections. Concentric cylinder sections may take the form of a sleeve or sleeve assembly. A sleeve may expand into an open position by a twisting action and locking system that retains the sleeve in an extended position wherein the cap may be removed and the pins may be accessed. After use, the sleeve may be retracted and the cap replaced.

Disclosed embodiments include a pin cup that may be disposed within a shell, with the shell moving along a vertical axis to accommodate an open or closed position. In an open position the shell may lower, exposing the pins in the pin cup. In a closed position the shell may raise, so as not to disturb the pins in the pin cup, but to allow the lid to cover the pins in a position above the pins.

In the open position, the lid may be attached or secured to the bottom of an embodiment so as to not allow the lid to be misplaced.

These and other objects and advantages will be made apparent when considering the following detailed specification when taken in conjunction with the drawings.

REFERENCE NUMERALS IN THE DRAWINGS

Figure 1:
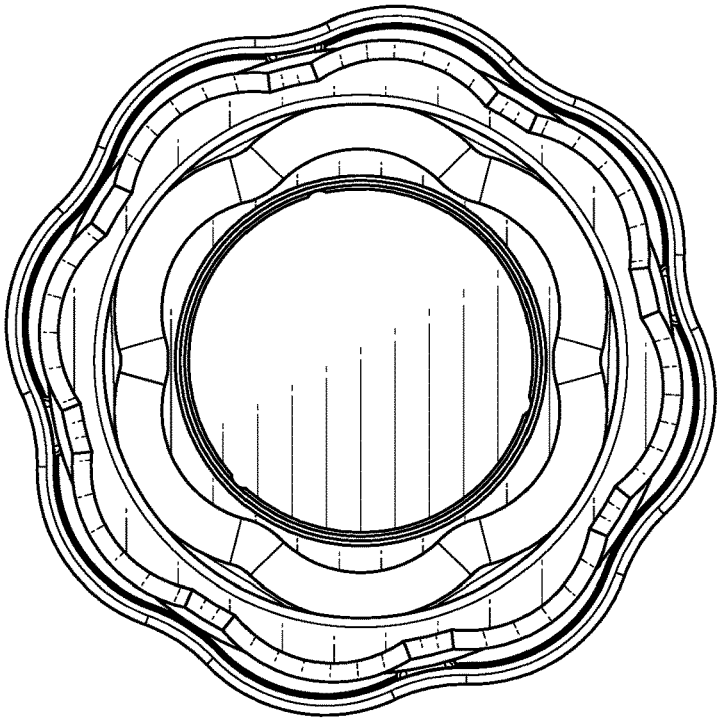
FIG. 1 depicts a bottom view in a closed position

100 pin holder
110 lid
120 shell
121 cylinder offset
122 vertical bar
123 short edge of cylinder offset
124 lower lip of shell 120
125 lower circular void defined by vertical bar 122, cylinder offset, lower lip 124 and short edge 123
126 vertical void defined by vertical bar 122, short edge 123 and lower lip 124
127 upper surface of cylinder offset
128 inner surface of shell
129 upper surface of shell
130 pin cup
131 flange of pin cup 130
132 outer protrusion of pin cup 130
133 upper vertical lip of pin cup 130
134 concave section of pin cup 130
140 magnet
150 washer
160 magnet holder
190 lower horizontal surface of cylinder offset 121
200 pins

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts a bottom view in a closed position, thus the lid is shown as the outermost concentric circle.

Figure 2:
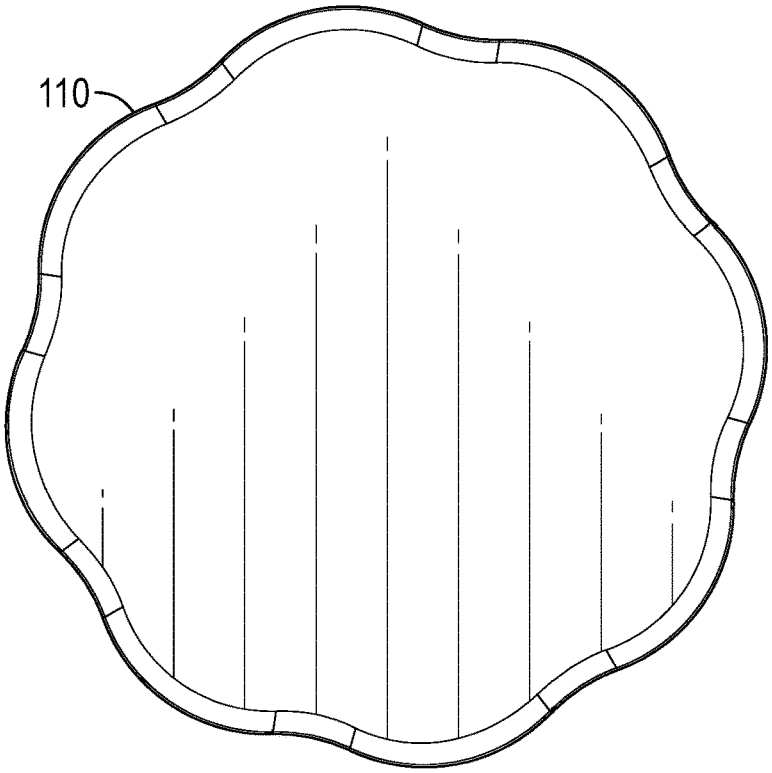
FIG. 2 depicts a top view in a closed position

FIG. 2 depicts a lid 110. The lid may be magnetic and/or attach to the shell by means of friction or screw threads.

Figure 3:
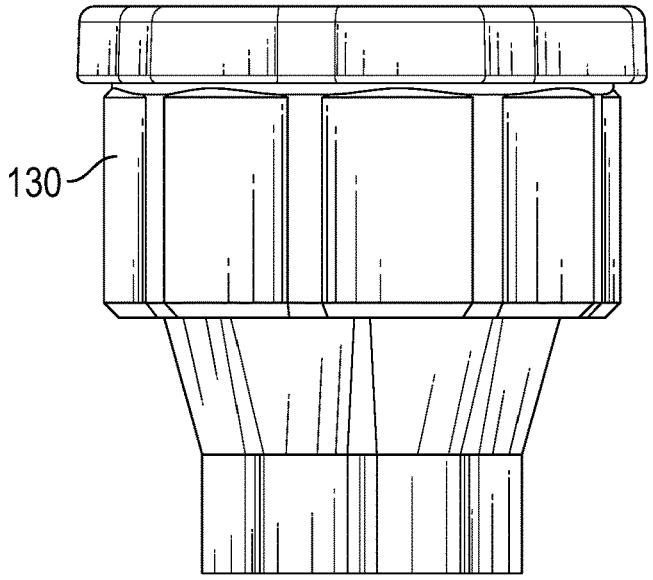
FIG. 3 depicts a side view in a closed position

FIG. 3 depicts a side view or elevational view with the lid attached and the shell 120 extended away from the pin cup 130.

Figure 4:
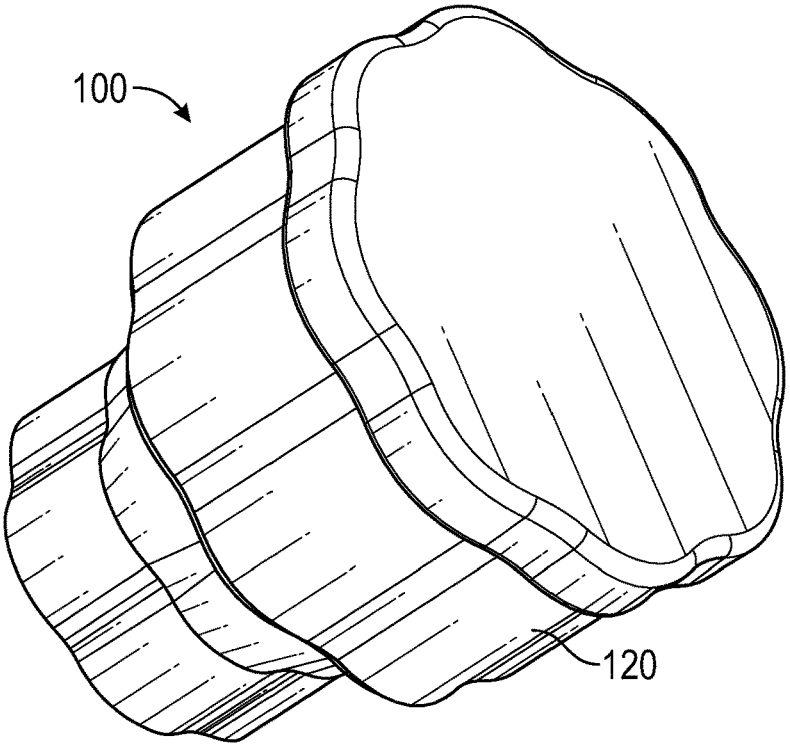
FIG. 4 depicts a perspective view in a closed position

FIG. 4 depicts a perspective view of showing the exterior of the lid, shell and pin cup.

Figure 5:
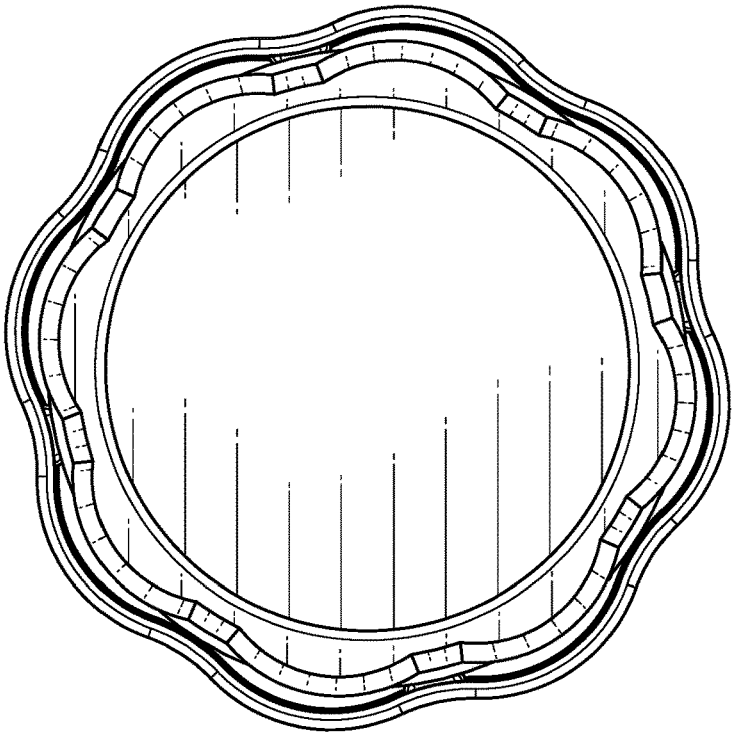
FIG. 5 depicts a top view in an open position

FIG. 5 depicts a top view in an open position. The lid has been placed at the bottom and the shell has been lowered to cover the pin cup.

Figure 6:
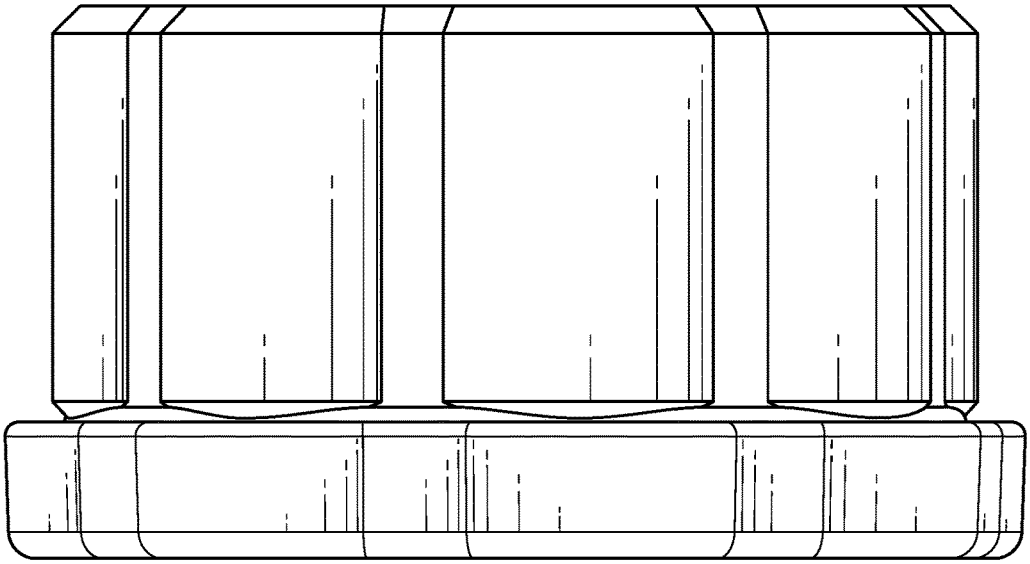
FIG. 6 depicts an side view in an open position

FIG. 6 depicts a side view with the top of the pin cup exposed over the shell.

Figure 7:
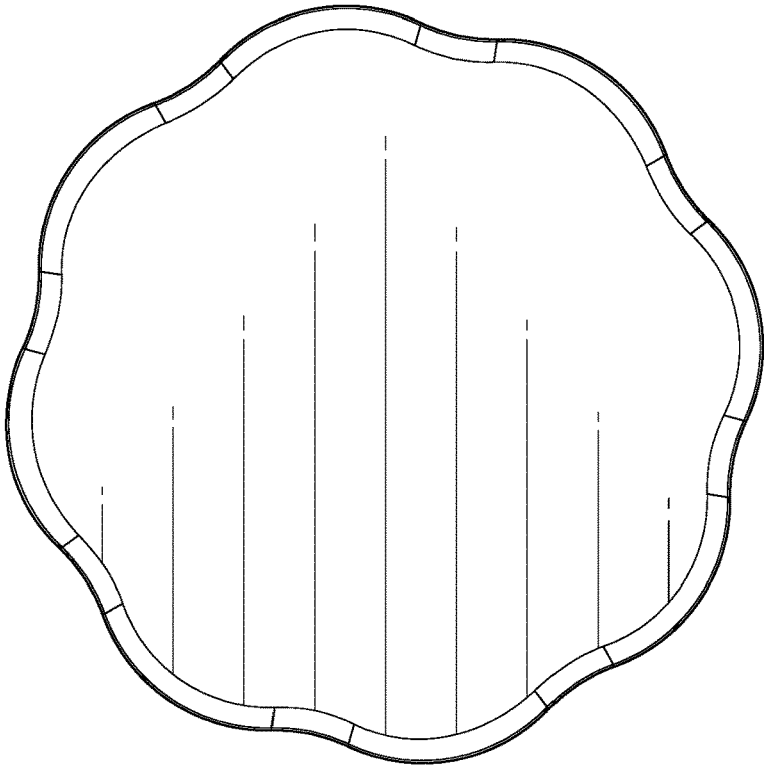
FIG. 7 depicts a bottom view is an open position

FIG. 7 depicts a bottom view which is of the lid.

Figure 8:
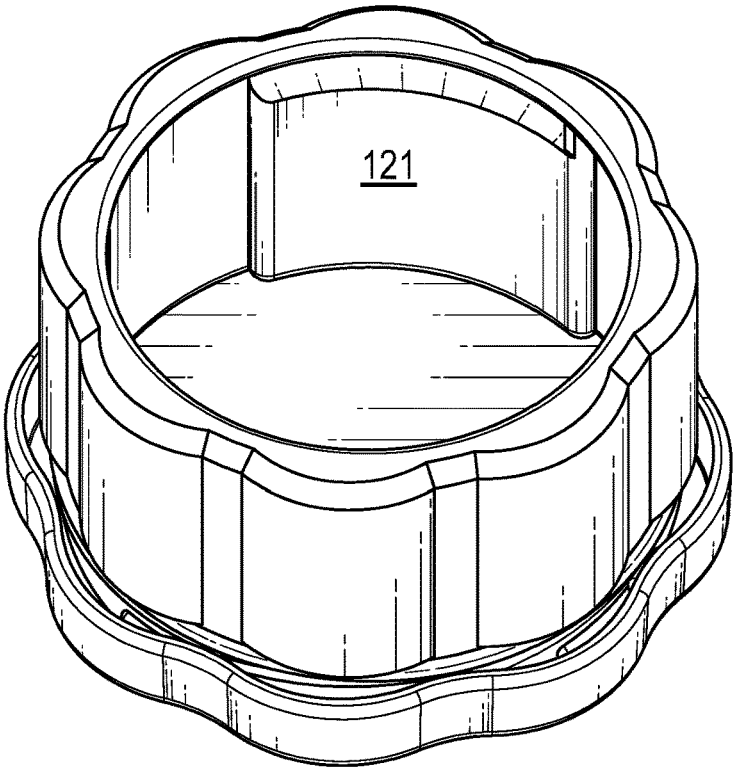
FIG. 8 depicts a perspective view in an open position

FIG. 8 is a perspective view in an open position.

Figure 9:
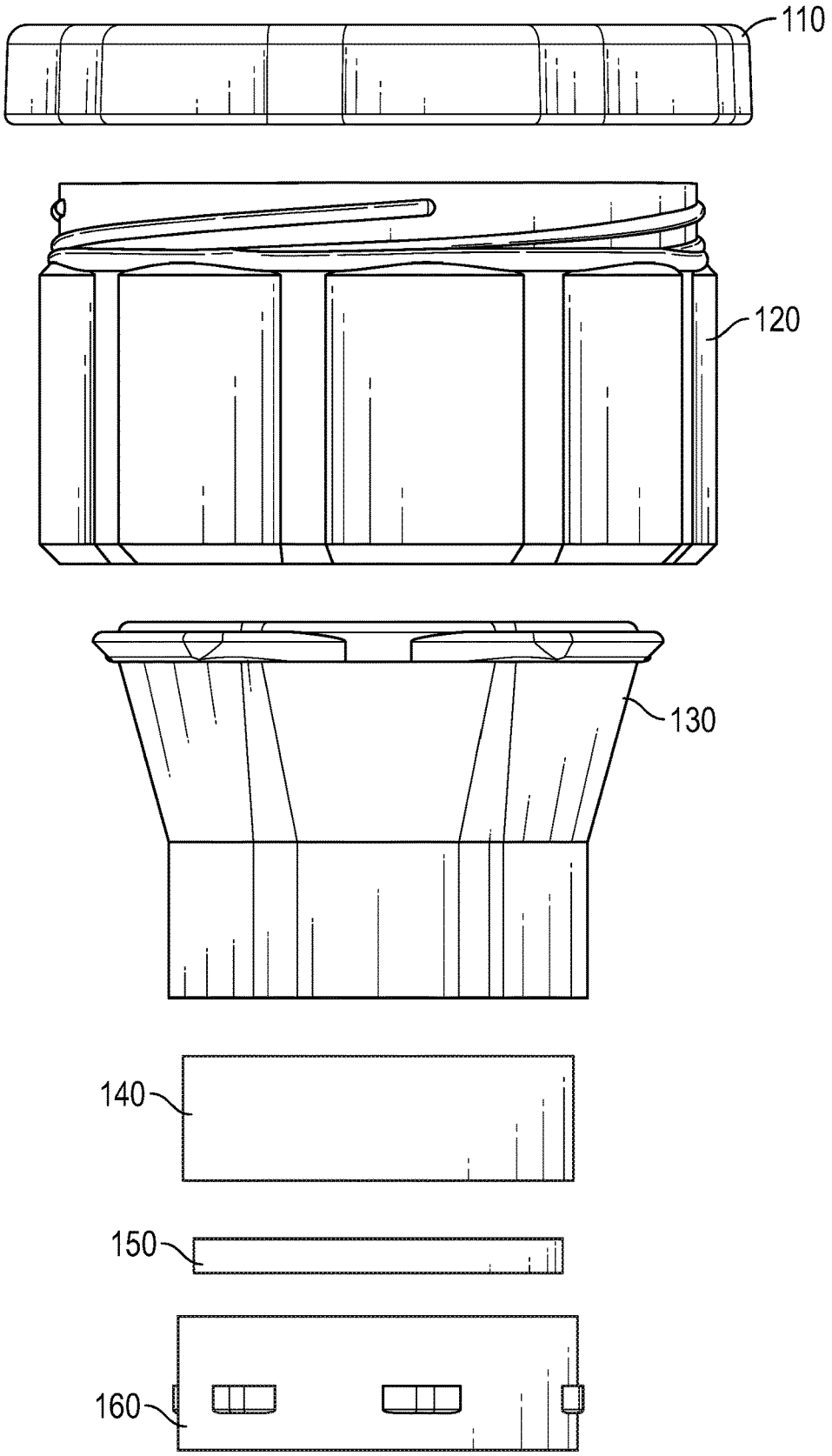
FIG. 9 depicts an exploded view

FIG. 9 is an exploded view depicting a lid 110, shell 120, pin cup 130, magnet 140, washer 150 and magnet holder 160.

Figure 10:
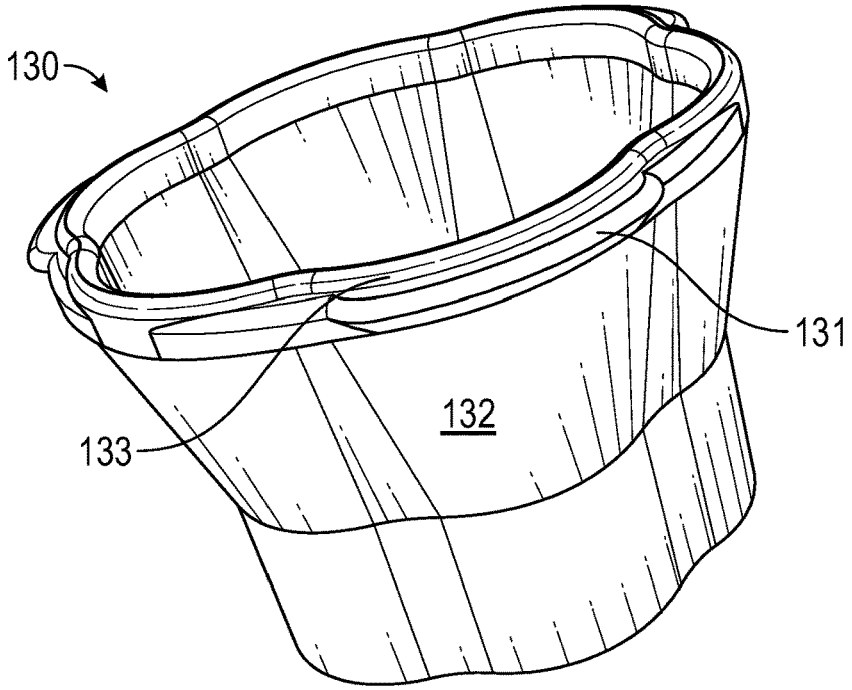
FIG. 10 depicts a perspective view of a pin cup

FIG. 10 depicts a pin cup 130 comprising a plurality of flanges 131, the flanges being useful in locking the pin cup in a lower position within the shell for pin storage and the flanges being useful in supporting the pin cup on the top surfaces of the shell when the pins are in use. The upper vertical lip 133 of the pin cup may be useful in keeping pins away from the edges or workings of the outer surfaces of the pin cup and shell.

Figure 11:
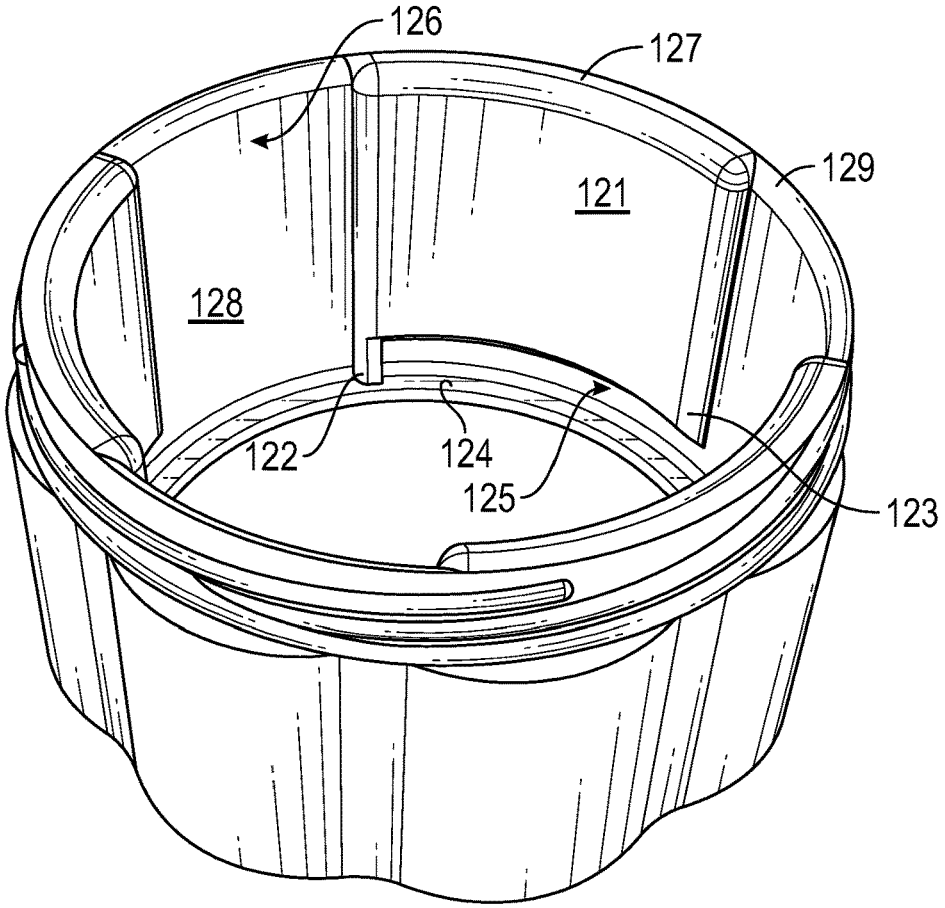
FIG. 11 depicts a perspective view of a shell
Figure 15:
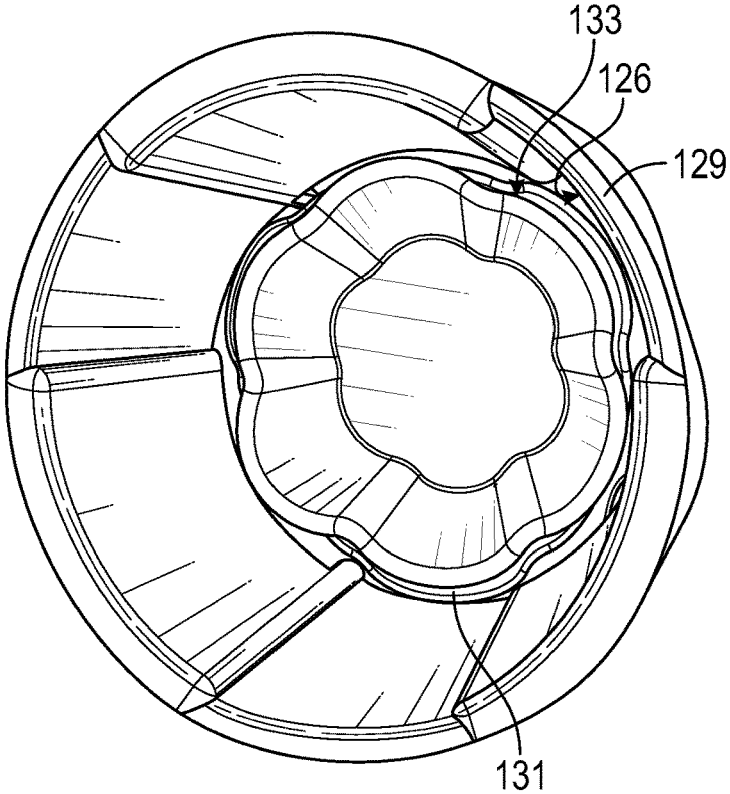
FIG. 15 depicts a pin cup in position to rise within a sleeve
Figure 16:
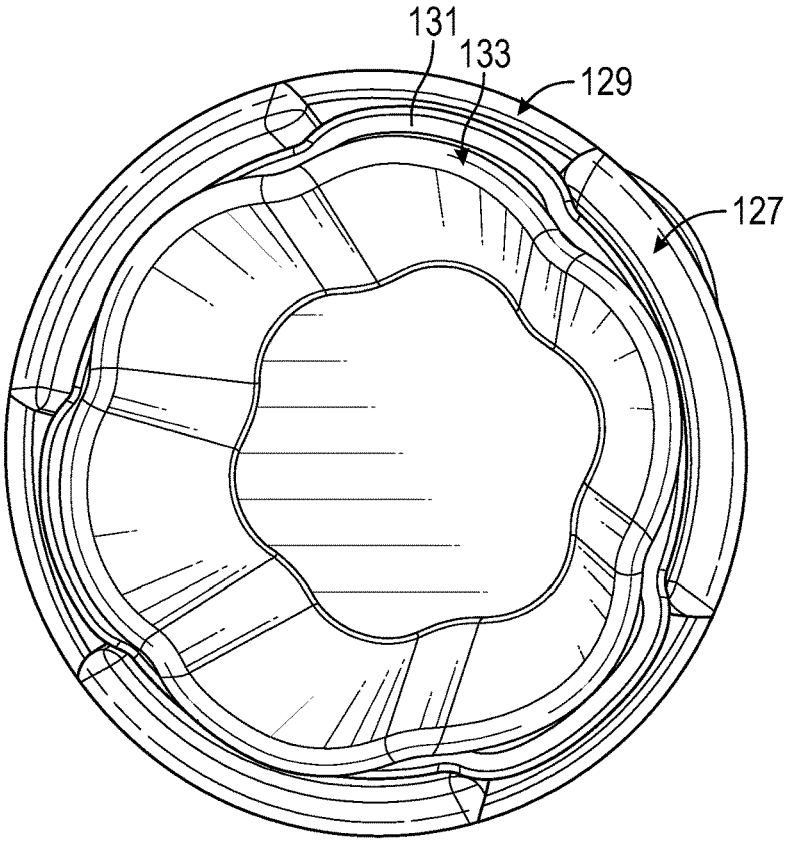
FIG. 16 depicts a pin cup in the upper part of a sleeve

FIG. 11 depicts a shell comprising a plurality of vertical voids 126 defined by an inner surface 128 of the shell, a lower lip 124, a short edge 123 of a cylinder offset 121 and a vertical bar 122. The vertical voids are useful in matting with the outer protrusions 132 of the pin cup such that the flanges 131 of the pin cup may pass vertically within the sleeve. The vertical voids are also useful in assembling the system such that the flanges 131 and pin cup may pass through the sleeve when the flanges are positioned or aligned within the vertical voids as shown in FIG. 15 and FIG. 16.

A sleeve may further comprise a lower circular void 125 which may be sectional and may be defined by one or more vertical bars, the lower lip 120 of the shell, a lower horizontal surface 190 of a cylinder offset 121. The lower circular void 125 is useful in securing the pin cup in a lower position as the flanges 131 of the pin cup travel in a lower position along the vertical voids 126 until reaching the lower lip 124 of the shell. Then, the pin cup may be rotated such that the flanges 131 are positioned under the lower horizontal surfaces 190 of the cylinder offsets 121. The vertical bars 122 become useful in stopping the rotation of the flanges in a locked position, secured by the lower lip 124 of the shell and lower horizontal surfaces 190. In general, the flanges 131 rotate within the lower circular void 125 to reach either a locked under a cylinder offset or free position within a vertical void 126.

Figure 12:
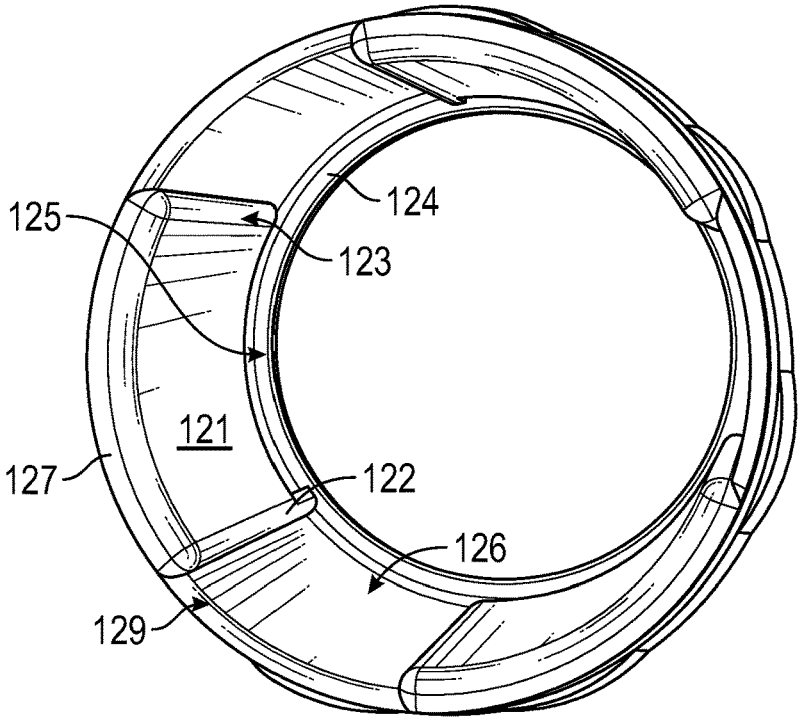
FIG. 12 depicts a perspective view of a shell

With a pin cup in a lower locked position, pins in a pin cup may retain their positions and the system may be sealed for safety by use of the lid 110. The lid may screw on the FIG. 12 depicts a shell comprising a lower lip 120, a short edge 123, cylinder offset 121, and short edge 123 of cylinder offset. A lower circular void 125 may be defined by or within a vertical bar 122, lower lip 124 of shell and a lower edge of a cylinder offset 121. A vertical void may be defined by a shell wall, a vertical bar 122, an upper surface 129 of the shell, a short edge 123 of the vertical offset and sometimes a lower lip 124. The vertical void 126 of the shell may be matted or may accommodate a flange 131 (see FIG. 10) of a pin cup 130. The flange 131 of the pin cup overcomes shortfalls in the art by allowing travel within the shell and by allowing locking in an upper position by the flange sitting on top of upper surfaces 127 of the cylinder offset. The flange 131 further overcomes shortfalls in the prior art by matting with and/or being retained within a lower circular void 125, wherein the pins or other contents of the system may be safely retained and stored.

Figure 13:
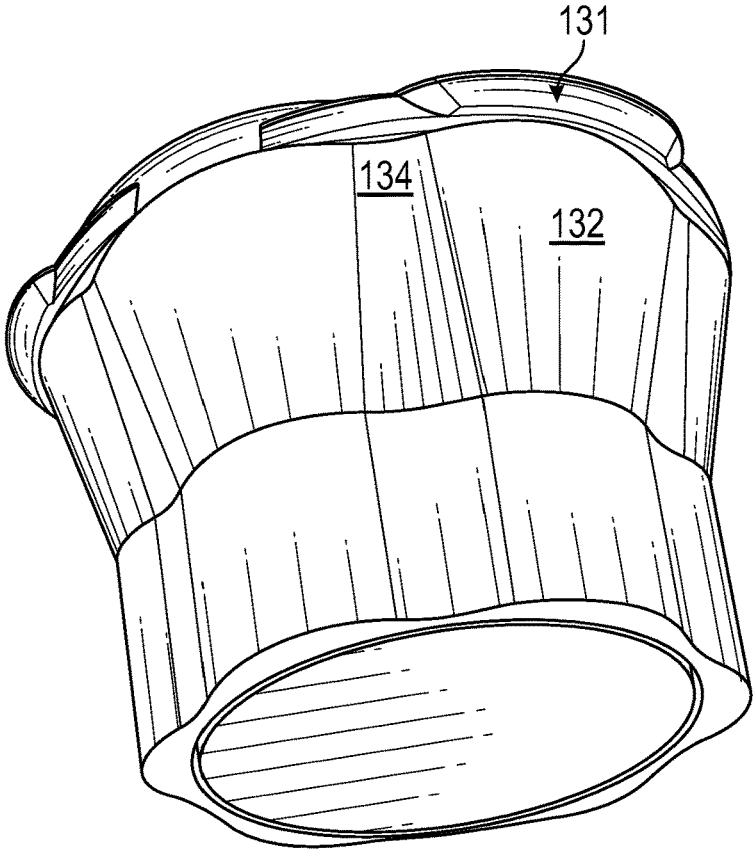
FIG. 13 depicts a perspective view of a pin cup

FIG. 13 depicts outer surfaces of a pin cup which may comprise a plurality of flanges 132, outer protrusions 132 and concave sections 134.

Figure 14:
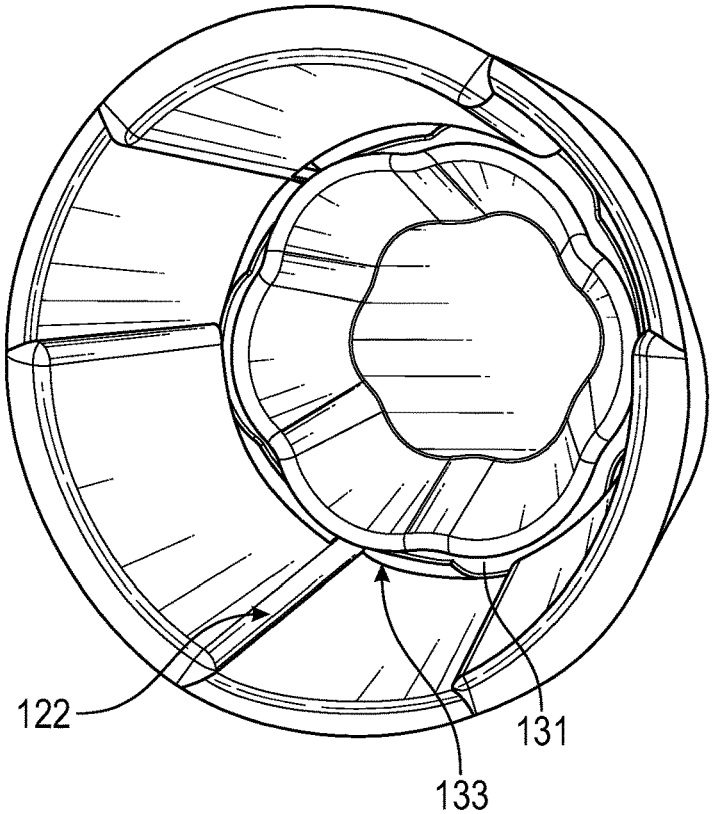
FIG. 14 depicts a pin cup locked in the lower section of a sleeve

FIG. 14 depicts inner surfaces of a shell and cup, with the cup in a lowered position and locked in said lowered position.

FIG. 15 depicts a cup aligned to rise within the shell. The cup in unlocked as the cups flanges are aligned within vertical voids 126 of the shell.

FIG. 16 depicts a pin cup in a raised position and in position to be raised or lowered by virtue of a cup flange 131 being aligned with a vertical void. This configuration overcomes shortfalls in the art as the cup may be moved more upwardly and thus be separated from the shell. This feature is helpful in assembling the system without tools.

Figure 17:
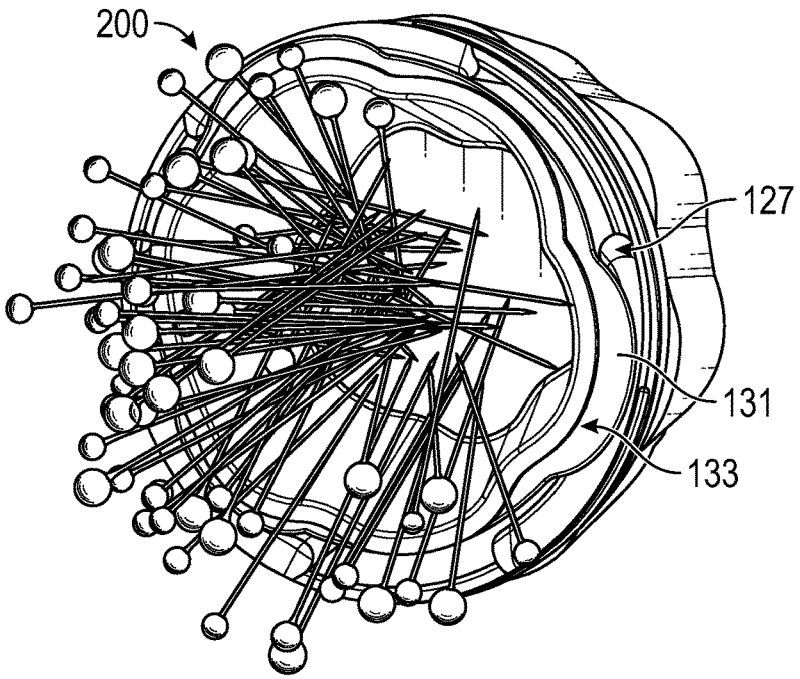
FIG. 17 depicts a pin cup upwardly supported by a sleeve

FIG. 17 depicts pins disposed within a pin cup and the pin cup secured in an upper position as the pin cup flanges 131 are rotated so as to rest upon the upper surfaces 127 of the cylinder offset.

The disclosed embodiments overcome shortfalls in the art by allowing pin heads to remain in a vertical top position by use of magnets pulling the sharp side of the pins downwardly.

What is claimed is:

1. A container system for storing and presenting pins, the container system comprising:

a) a shell (120); the shell comprising an inner surface with a plurality of cylinder offsets (121) attached to the inner surface; the cylinder offsets each comprising a short edge (123), a vertical bar (122), a lower surface and an upper surface (127); the shell further comprising a plurality of vertical voids with each vertical void defined by the inner surface of the shell, one of the short edges, and one of the vertical bars; the shell further comprising a lower circular void defined by the vertical bars, the lower surfaces of the cylinder offsets and an upper surface of a lower lip (124); and b) a pin cup comprising a plurality of outer protrusions (132), a plurality of concave sections (134), a upper surface comprising a plurality of flanges (131), such that the flanges may slide within the vertical voids of the shell and such that the flanges may be retained within the lower circular void of the shell.

2. The container of claim 1 further including a magnet (140) retained within a lower section of the pin cup.

3. The container of claim 1 further comprising a magnet holder (160) retaining the magnet and the magnet holder disposed within the pin cup.

4. The container of claim 1 further comprising a lid (110) in threaded attachment to the shell.

* * * * *